United States Patent [19]

Rodi et al.

[11] Patent Number: 4,753,433

[45] Date of Patent: Jun. 28, 1988

[54] DEVICE FOR MONITORING IMBRICATED SHEETS STREAM FED TO PRINTING MACHINES

[75] Inventors: Anton Rodi, Leimen; Dieter Uhrig, Eberbach, both of Fed. Rep. of Germany

[73] Assignee: Heidelberger Druckmaschinen AG, Heidelberg, Fed. Rep. of Germany

[21] Appl. No.: 40,574

[22] Filed: Apr. 17, 1987

[30] Foreign Application Priority Data

Apr. 24, 1986 [DE] Fed. Rep. of Germany ..... 3613969

[51] Int. Cl.[4] ..... B65H 7/12

[52] U.S. Cl. ..... 271/263; 271/151; 271/199; 271/202; 271/265

[58] Field of Search ..... 271/263, 265, 151, 199, 271/202, 203

[56] References Cited

U.S. PATENT DOCUMENTS 4,420,151 12/1983 Kobayashi ..... 271/263

4,560,159 12/1985 Staub ..... 271/263

*Primary Examiner*—Richard A. Schacher

*Attorney, Agent, or Firm*—Herbert L. Lerner; Laurence A. Greenberg

[57] ABSTRACT

Device for monitoring imbricated sheets stream fed to a printing machine, including a scanning roller rotatably mounted on a carrier above a base of imbricatedly arranged sheets, the carrier being adjustable by a servomotor so that the scanning roller rotates only when a given number of sheets are arranged on top of one another, a sensor cooperatively associated with the scanning roller, and an intermediate roller movable transversely with respect to its axis and substantially perpendicularly to the plane of the sheets, the intermediate roller being disposed between the scanning roller and the base, comprising a device for measuring the distance of at least one of the scanning roller and the intermediate roller to the base of the overlapped sheets, a control unit coupled with the sensor, the servomotor and the measuring device and a device for producing a signal characteristic of an angle of rotation of the printing machine, the signal being fed to the control unit, the control unit having a device for monitoring the imbricated sheet structure, the scanning roller being mounted so that its rotation is unlimited, and the sensor having a device for detecting all rotational movements of the scanning roller.

11 Claims, 7 Drawing Sheets

DEVICE FOR MONITORING IMBRICATED SHEETS STREAM FED TO PRINTING MACHINES

The invention relates to a device for monitoring imbricated or overlapping sheets stream fed to printing machines, with a scanning roller rotatably mounted on a carrier above a base of imbricatedly or overlappingly arranged sheets, the carrier being adjustable by a servomotor so that the scanning roller is turned only when a given number of sheets are arranged on top of one another, with a sensor cooperatively associated with the scanning roller, an intermediate roller moving transversely with respect to its axis and substantially perpendicularly to the plane of the sheets being provided between the scanning roller and the base.

In a device of this general type known from German Patent No. 31 18 010, the scanning roller, which does not make direct contact with the sheets, but rather is driven by a roller arranged between the sheets and the scanning roller, is rotatable to a limited extent. A sensor detects when the scanning roller has covered a predetermined angle of rotation and then issues a corresponding signal. A spring is provided which swings the scanning roller back from the last-mentioned position to its original or base position. In the original position, a contact is actuated by the scanning roller, with the result that an indicator lamp is kept in off condition. The scanning roller and the intermediate roller are mounted on a carrier. The height of the carrier and therefore the height of the intermediate roller above the base underlayer of the sheets, which is a driven roller, can be set by means of an electric motor switchable by a machine operator. The setting is performed in a manner that, for example, in the case of two sheets lying one on top of the other, the intermediate roller does not make contact with the scanning roller so that the latter remains in its original or home position, however, in the case of three sheets, the intermediate roller turns the scanning roller in a direction opposing the force of the spring. The indicator lamp lights as a result. The indicator lamp goes out once again at the end of the triple overlap. In this way, the operator can check the correct setting of the monitoring device and, if necessary, correct the setting by switching on the electric motor. If the overlap is too long, a multiple sheet is in the stream, which causes the sensor to respond and release a fault signal.

In the case of this heretofore known device, the length of the overlap region, in which the sensor is not yet actuated, is determined by the size of the pivot angle of the scanning roller up to the triggering point for the sensor and can therefore not be changed, or can be changed only with difficulty. Especially when using sheets for the first time with a thickness which has theretofore not been used, setting or adjusting of the monitoring device requires a particularly high degree of care. To set up the heretofore known machine, a drive pulse which increases the distance or spacing of the scanning roller to the underlying paper base is applied to the motor adjusting the height of the carrier when the scanning roller turns, it being assumed that the motor is to be switched on only when the number of sheets arranged one on top of the other and causing the roller to turn is smaller than as preset. This procedure, however, must be monitored by the operator.

After a permissible overlap has occurred, the scanning roller of the heretofore known machine requires a given time to return to its original or home position. To ensure that the scanning roller can follow short distances or spacings between the overlaps, a strong return or restoring force must be produced for the scanning roller and, correspondingly, a sufficiently strong preloaded spring must be provided. Tensioning this spring during an overlap brakes and slows down the sheets and can influence the sheet transport as well as damage the surface of the sheets, particularly when they have already been printed.

It is accordingly an object of the invention to provide a monitoring device of the type described in the introduction hereto which is relatively easy to handle.

With the foregoing and other objects in view, there is provided, in accordance with the invention, a device for monitoring imbricated sheets stream fed to a printing machine, including a scanning roller rotatably mounted on a carrier above a base of imbricatedly arranged sheets, the carrier being adjustable by a servomotor so that the scanning roller rotates only when a given number of sheets are arranged on top of one another, a sensor cooperatively associated with the scanning roller, and an intermediate roller movable transversely with respect to its axis and substantially perpendicularly to the plane of the sheets, the intermediate roller being disposed between the scanning roller and the base, comprising a device for measuring the distance of at least one of the scanning roller and the intermediate roller to the base of the overlapped sheets, a control unit coupled with the sensor, the servomotor and the measuring device, and a device for producing a signal characteristic of an angle of rotation of the printing machine, the signal being fed to said control unit, said control unit having means for monitoring the imbricated sheet structure, the scanning roller being mounted so that its rotation is unlimited, and the sensor having means for detecting all rotational movements of the scanning roller.

Such a monitoring system is made possible by the fact that the signal characteristic for the angle of rotation can determine whether the leading edge of a sheet actually arrives at the scanning roller at the instant of time at which it should arrive, or whether the leading edge of a sheet fails to arrive at this instant of time or arrives at different instants of time. With the device for measuring the distance or spacing of the scanning roller to the underlying base of sheets, the thickness of the sheet running under the scanning roller can be determined quickly, and this information can be used for subsequent monitoring of the sheet overlap structure.

The signal characteristic for the angle of rotation of the machine is for all intents and purposes a clock signal which indicates to a sufficient degree of accuracy the respective angle of rotation of the printing machine, for example, 1,024 pulses for one complete rotation of the printing machine. The rotary motion of the scanning roller is not or not necessarily used to determine the length of an overlap region of several sheets.

Through German Published Non-Prosecuted Application (DE-OS) No. 29 30 270, a monitoring or control device for feeding sheets has become known heretofore, which seeks to detect irregularities in the sheet feed, by providing a displacement or motion pick-up by which measurement of the distance or spacing between two rollers which corresponds to the thickness of a sheet lying between the rollers is facilitated. With the heretofore known device, however, the roller coupled to the motion pick-up or transducer is constantly pressed against the other roller by a spring, thereby impairing the surface quality, especially, of sensitive sheets. The roller coupled with the motion pick-up or transducer is not used for determining the length of the overlap region.

The invention encompasses two closely related embodiments, in one of which the scanning roller interacts or cooperates directly with the sheets and, in the other of which, in accordance with the state of the art referred to in the introduction hereto, the scanning roller is turned by an intermediate roller when the intermediate roller is raised and turned by sheets running under it.

A further advantage of the device according to the invention, without an intermediate roller, is that the device can be adjusted in such a way that, when sheet transport is operating correctly, the scanning roller does not come in contact with the sheets. Only when too many sheets are arranged one on top of the other does the scanning roller come into contact with the topmost sheet and is then turned by this sheet, and the sensor indicates this fact by issuing a fault signal.

The spacing of the leading edges of sheets in direct succession depends upon the type of feeder used. The maximum number of overlapping sheets therefore depends upon the sheet length. In simpler embodiments of the invention, the maximum number of overlapping sheets can be entered by the operator in the control unit or, on the other hand, the sheet length can be entered and the unit determines the maximum number of overlapping sheets.

In accordance with one embodiment of the invention, however, the control unit has means for determining the sheet length automatically. This results from the fact that a reduction of the total thickness of the sheets lying on top of one another is detected, and the trailing edge of a sheet is thereby determined. This embodiment makes it possible for the device to determine completely automatically the maximum permissible number of overlapping sheets.

If the maximum number of overlapping sheets is known, the advantageous possibility is created of setting the scanning roller and intermediate roller, responsively, automatically and rapidly to a height at which the sheets coming in direct contact with the roller, i.e. the scanning roller and intermediate roller, respectively, only make contact when a predetermined number of sheets overlap. A further advantage of such a setting or adjustment is that the height of the scanning roller or intermediate roller i.e. the minimum distance or spacing of the scanning roller and intermediate roller, respectively, to the underlying base of sheets, which in general will be a driven roller, is greater than the total thickness of the maximum permissible overlapping sheets by less than one sheet thickness.

In accordance with an added feature of the invention, the control unit has means for determining the thickness of the sheet by vertical adjustment of the carrier, and for setting the scanning roller and intermediate roller, respectively, to a height which is greater than the thickness of a single sheet, yet smaller than double the sheet thickness, when the first sheet runs under the scanning roller and intermediate roller, respectively.

If the leading edge of a second sheet is then detected which overlaps with the first sheet, the control unit ensures that the scanning roller and intermediate roller,respectively, is set to a level which is greater than double the sheet thickness yet smaller than triple the sheet thickness, and so on.

In accordance with an additional feature of the invention, the control unit has means for evaluating the signal characteristic for the direction of rotation of the printing machine in order to determine the length of the overlapping region, during the presence of the signal from the sensor indicating the rotation of the scanning roller.

In accordance with yet another feature of the invention, a force generating device is provided which subjects the scanning roller to a load which is adjustable by the control unit. Whereas, in accordance with the state of the art, for example in the foregoing publication, the force with which the scanning roller rests on the surface of the sheet is provided by a spring and can only be adjusted manually, the device according to the invention enables automatic adjustment of the force. The sheet thickness, if necessary together with data relating to the type of paper, can be used as a measure for this purpose. The force to be set can be stored in a memory of the control unit. Provided the paper thickness determines the force, the control unit which automatically detects the paper thickness can itself set the force automatically. If necessary, the force can be set independently of the position of the scanning roller. In accordance with a further feature of the invention, an electric motor can be used as the force generating device.

In accordance with yet an added feature of the invention, the control unit compares, with respect to one another, the signal provided by the sensor and the signal characteristic for the angle of rotation of the machine and if deviations exceed a predetermined value issues a fault signal. Whereas the invention as described in the introduction hereto does not necessitate accurate recording of the direction of rotation of the scanning roller because all that is necessary is to record the fact that the scanning roller rotates, this embodiment of the invention calls for the scanning roller to issue a signal characteristic for the rotary direction of the scanning roller, enabling an indication with regard to the length of the overlap region. This signal is compared to the signal characteristic for the direction of rotation of the machine, which is preferably a clock signal, with its clock frequency being a measure for the transport speed of the sheets. If, for example, as a result of a blocking of the scanning roller, impermissible deviations occur between the angle of rotation of the scanning roller (or the time during which the scanning roller rotates) and the signal dependent upon the machine cycle, this fact is detected.

In accordance with a concomitant feature of the invention, the signal characteristic for the direction of rotation of the machine is a clock signal, and the control unit has means for comparing the arrival of the leading edge of a sheet at the scanning roller and intermediate roller, respectively, with the phase of the clock signal and for producing a fault signal in the case of an impermissible deviation. This configuration of the invention makes it particularly easy to monitor whether the leading edges of the sheets always occur within a given time interval determined by the machine cycle, as is the case when the device feeding the sheets to the printing machine is operating correctly.

Other features which are considered as characteristic for the invention are set forth in the appended claims.

Although the invention is illustrated and described herein as embodied in a device for monitoring imbricated sheets stream fed to printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
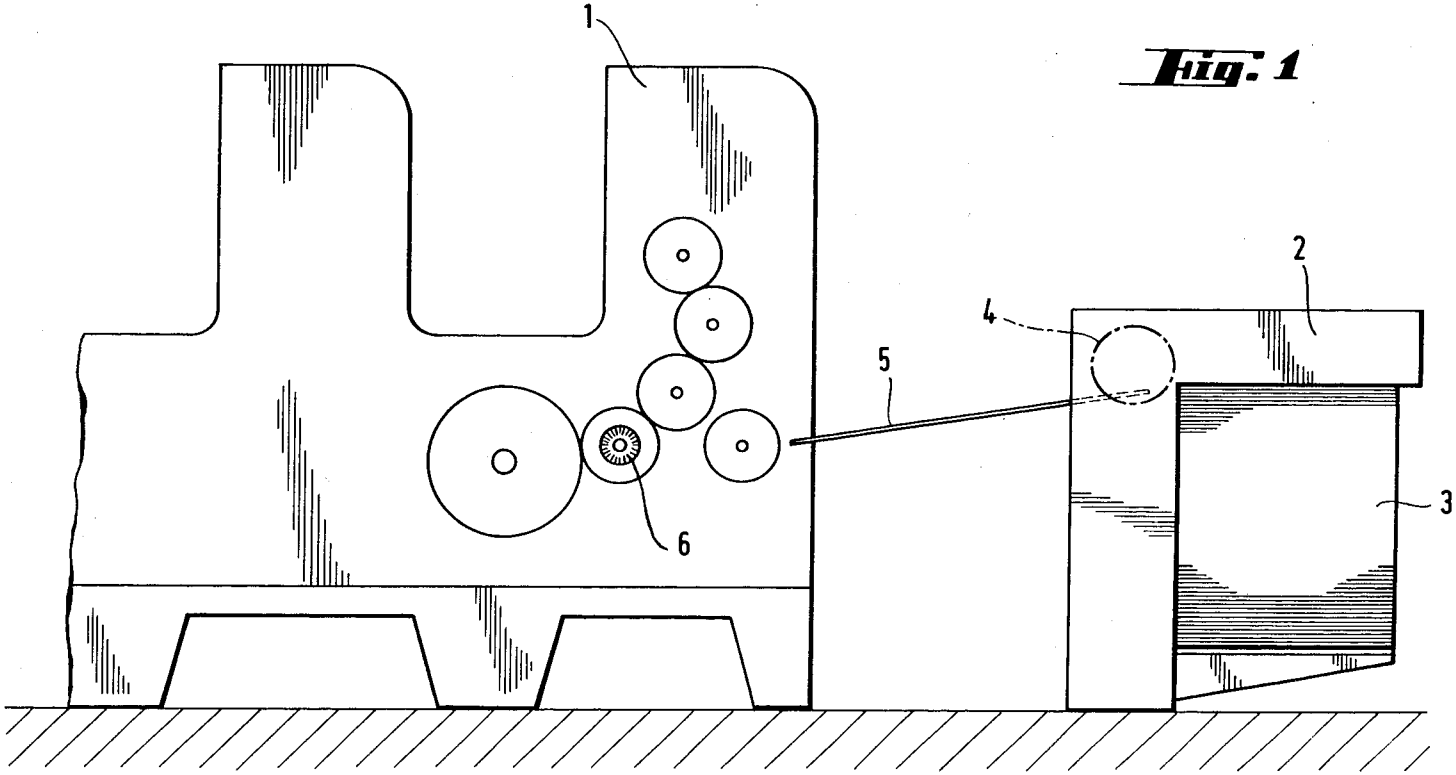
FIG. 1 is a diagrammatic side elevational view, partly broken away, of a printing machine with a sheet feeder.

Referring now to the drawing and first, particularly, to FIG. 1 thereof, there is shown, in a diagrammatic view, part of a printing machine 1, to which overlapping or imbricated paper sheets are fed from a pile 3 by a sheet feeder 2. The partly overlapping sheets run through a scanning device 4 and reach the machine 1 via a feed table 5. A clock pulse generator 6 is linked to a gearwheel of the printing machine 1 which performs one complete rotation during each cycle of the machine which corresponds to a single printing operation. This is represented only diagrammatically and features a graduated disc having 1,024 markings in this embodiment. The rotation of the graduated disc is scanned by a photoelectric light barrier which generates a clock signal corresponding to the rotation of the graduated disc. The instantaneous angle of rotation of the printing machine 1 can be determined from the clock signal. A guide rail 8 arranged above the feed table 5 ensures that the sheets of paper will not be able to move too far upwardly.

Figure 2:
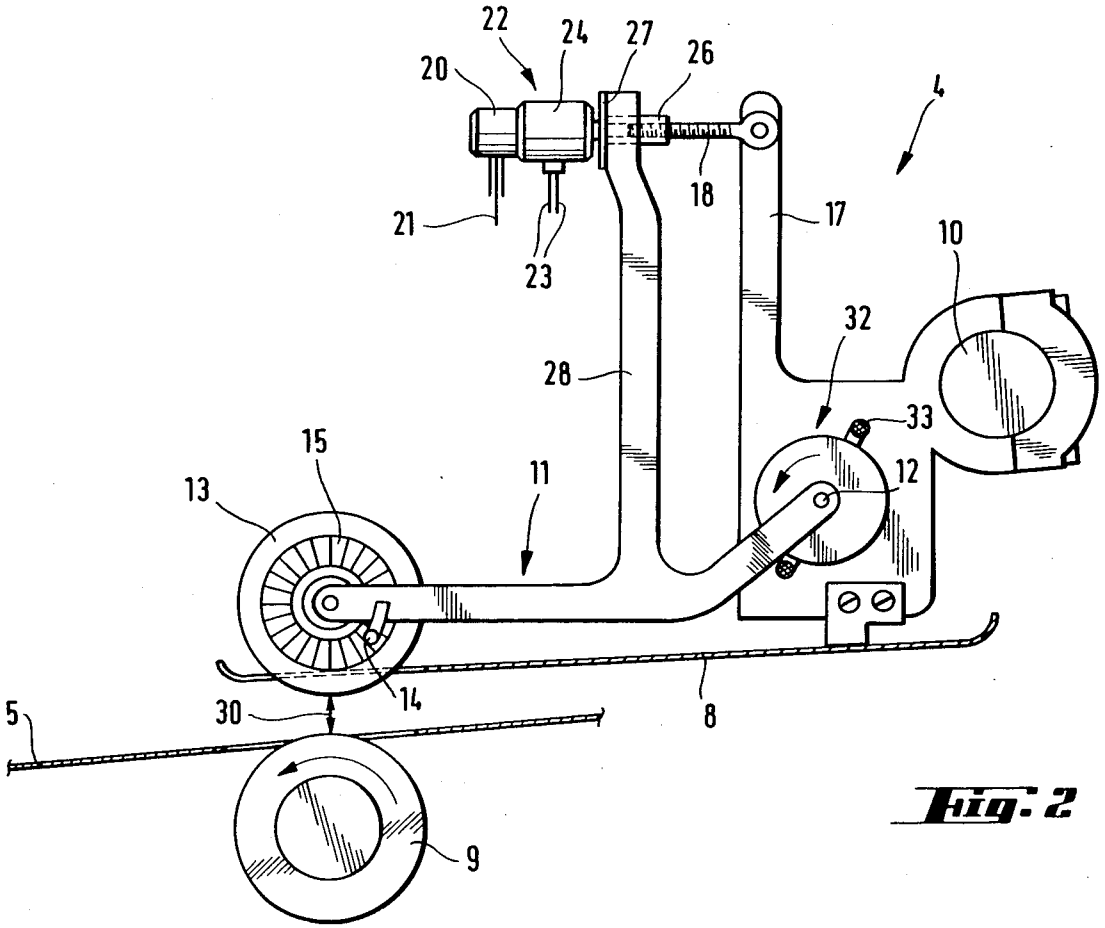
FIG. 2 is an enlarged fragmentary view of FIG. 1 showing part of a monitoring device provided in the sheet feeder.

FIG. 2 is a side elevational view of the scanning device 4. A rotating, driven transport roller 9 projects into an opening found in the feed table 5 and conveys paper sheets coming from the right-hand side to the left-hand side, as seen in FIG. 2. Pivotally mounted on a shaft 12 journaled on a fixed part 10 of the machine, is a multi-arm lever 11. An end of the lever 11 pointing towards the left-hand side in FIG. 2 carries a scanning roller 13 which has a graduation markings 15 which are scannable by a sensor 14 mounted on the lever 11, the graduation markings 15 together with the sensor 14 forming an incremental transducer. The sensor 14 is capable of detecting a rotation of the scanning roller 13. In one embodiment of the invention, the sensor 14, together with other equipment, is also capable of determining the angle of rotation of the scanning roller 13. The sensor 14 may be a motion or displacement pick-up of the type HEDS 6000, for example, manufactured by Hewlett Packard, Palo Alto, Calif. and known as an incremental optical encoder.

Joined to an upwardly projecting extension piece 17 of the fixed part 10 of the machine is a rod 18 formed with a thread. A sleeve 26 is screwable onto this thread and merges with a wider section 27 which serves as a limit stop for the movement of a further arm 28 of the lever 11 to the left-hand side in FIG. 2. The sleeve 26 is connected to the shaft of a DC motor 22. Power is supplied to the motor 22 via lines 23. On the left-hand side of the motor 22, as viewed in FIG. 2, a potentiometer 20 is mounted on a housing 24 of the motor 22. The shaft of the motor 22 is linked to the sliding wiper of the potentiometer 20 and a connecting line 21 of the potentiometer 20 is connected to the wiper. The housing 24 of the motor 22, in a non-illustrated manner, is secured against relative rotation with the rotor of the motor 22 by an extension of the housing 24 which engages in a slot formed in the fixed part 10 of the machine 1. The motor 22 can therefore rotate the sleeve 26 so that the total length of the rod 18 and the sleeve 26 is increased or reduced depending upon the direction of rotation of the motor 22 so that the spacing of the limit stop 27 from the extension piece 17 can thereby be varied.

By turning the sleeve 26, the distance 30 between the transport roller 9 and the scanning roller 13 can be changed when not raised by sheets of paper.

The shaft 12, on which the lever 11 is mounted, is connected to the rotor of another DC motor 32, which has a field generated by permanent magnets. Direct current can be fed to an armature winding 33 of the motor 32 which, depending upon the direction of current flow, exerts a torque on the lever 11 in counterclockwise or clockwise direction, as viewed in FIG. 2. Depending upon the current direction and current intensity, respectively, the pressure which is exerted by the scanning roller 13 on the sheet located between the scanning roller 13 and the transport roller 9 and which is produced by the weight of the individual components, taking into consideration the lever-arm ratios, can thereby be increased or decreased in order to produce a desired pressure or a desired force exerted by the scanning roller 13.

Figure 3:
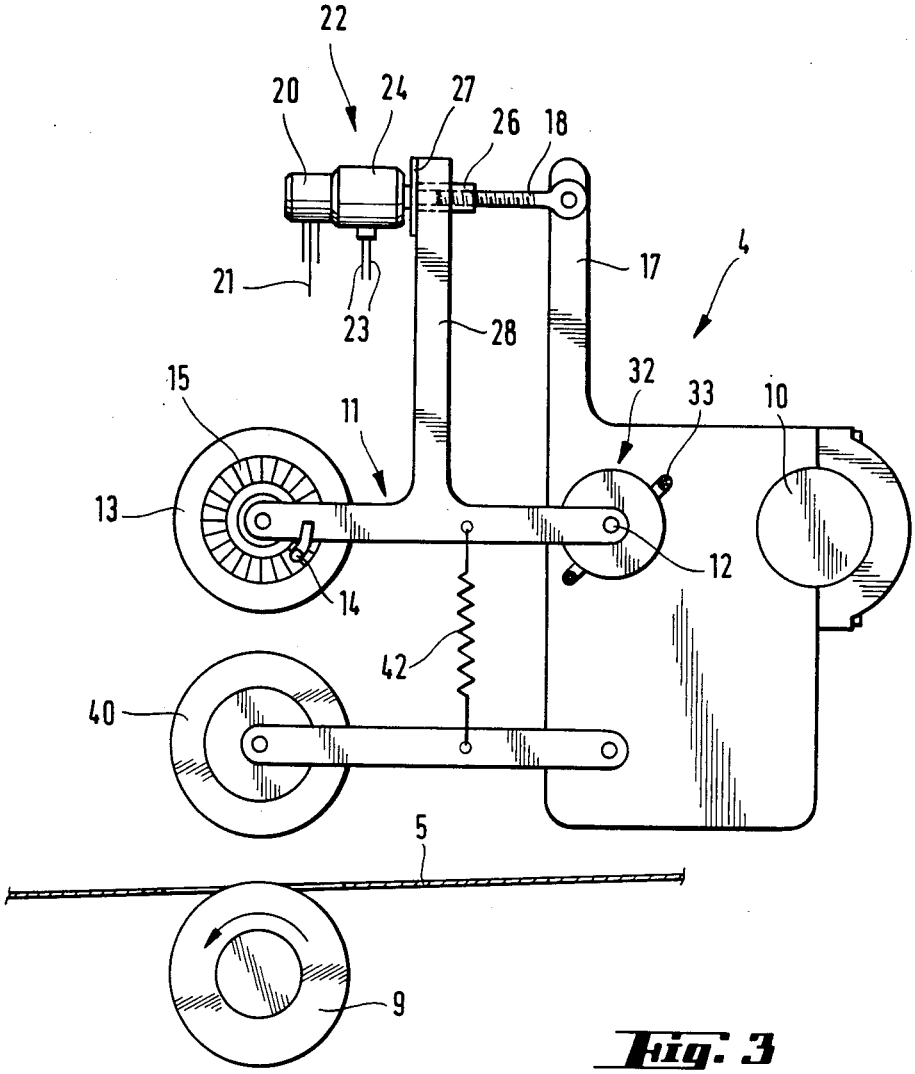
FIG. 3 is another embodiment of the device shown in FIG. 2.

The embodiment of the scanning device of the invention shown in FIG. 3 basically differs from the embodiment shown in FIG. 2, in that the scanning roller 13 cannot come into direct contact with the upper surface of the sheets of paper, but rather, there is arranged between the scanning roller 13 and the transport roller 9, an intermediate roller 40, the weight of which is carried or taken up by a tension spring 42 which is anchored to the lever carrying the scanning roller 13. In this embodiment of FIG. 3, the scanning roller 13 is turned only when the intermediate roller 40 is moved by the transport roller 9 through sheets of paper so that the intermediate roller 40 makes contact with the scanning roller 13. In this device, the lowermost position of the scanning roller 13 and, thereby, (taking into consideration the properties of the tension spring 42) of the intermediate roller 40 can be defined by adjusting the sleeve 26, and for as long as the aforementioned lowermost position of the rollers 13 and 14 has not been reached, the force with which the intermediate roller 40 presses on the sheets of paper can be adjusted by the current fed to the motor 32.

Figure 4:
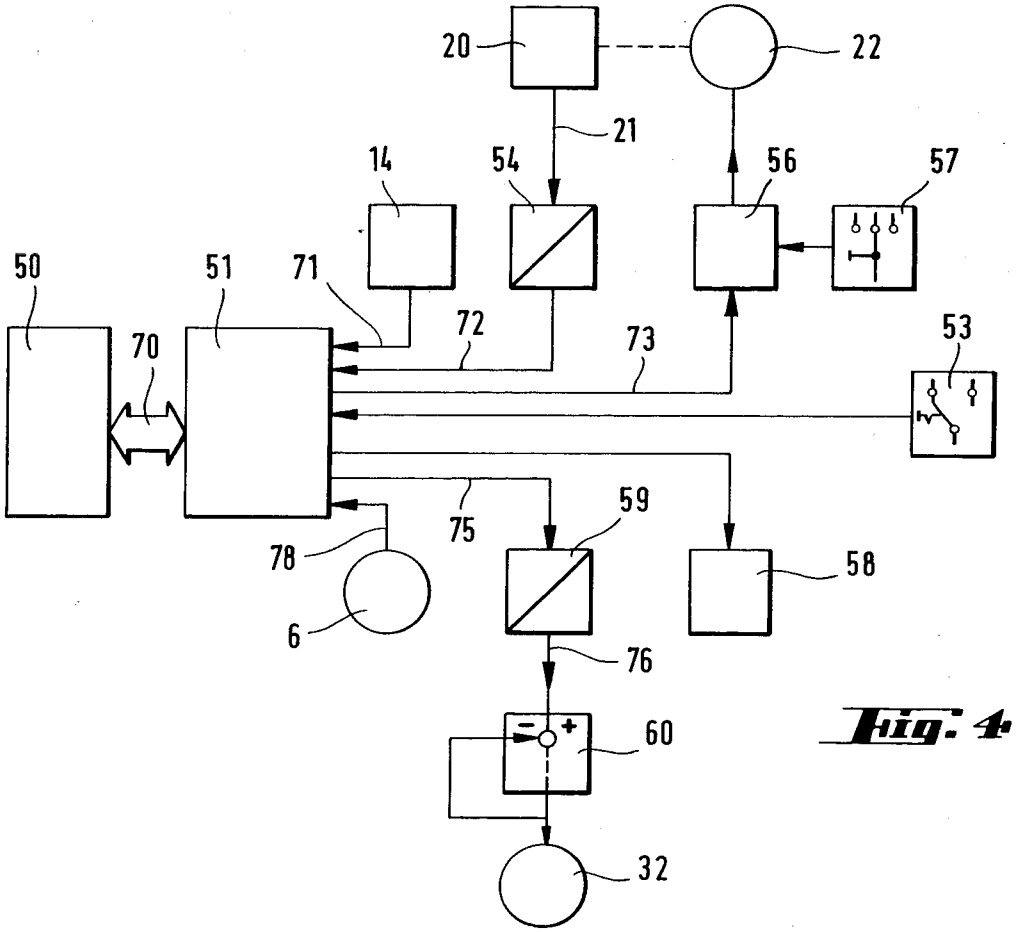
FIG. 4 is a block diagram of the monitoring device.

FIG. 4 shows the block diagram of an inventive monitoring device, containing the device shown in FIG. 2. A microcomputer 51, for example, an Intel: SBC86/12A, is connected via a bus system 70 with a machine control device 50 by which the printing machine 1 can be controlled. The connection as described enables a data exchange between the machine control 50, which may be another microcomputer like that at 51, and the device for monitoring the sheet feed.

Figure 8:
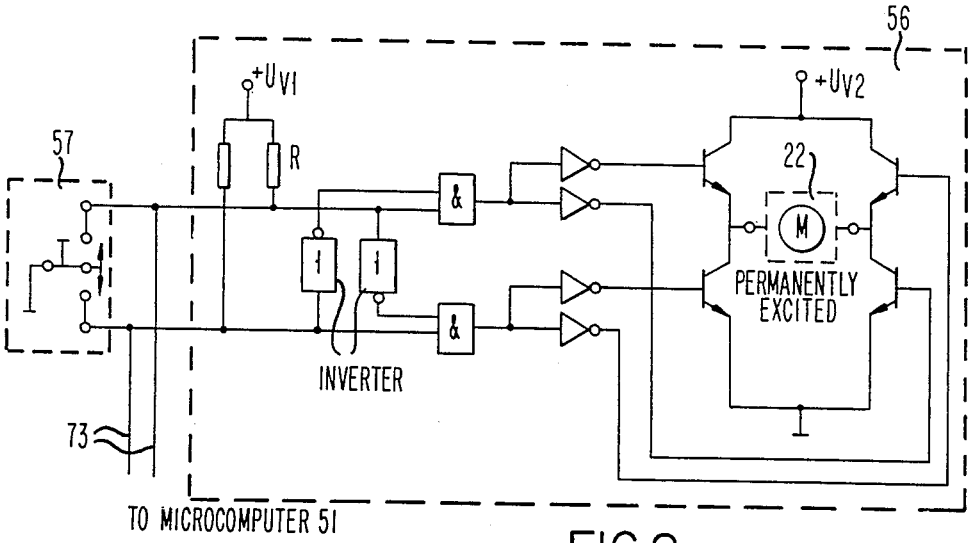
FIG. 8 is a circuit diagram of a driver stage actuatable by either a pushbutton or a computer, in accordance with the invention.
Figure 9:
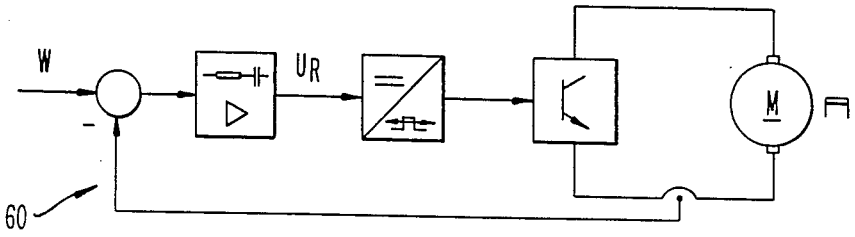
FIG. 9 is a circuit diagram of a motor current regulator according to the invention.

The clock pulse generator 6 (see FIG. 1) on the printing machine 1 sends a machine clock signal on a line 78 to the microcomputer 51 which can calculate and further process path lengths in conjunction with a signal which is provided on an output line 71 of the sensor 14. The required contact force which is produced by the motor 32 is calculated by the microcomputer 51, based upon the thickness of the individual paper sheets determined by a potentiometer 20, and is transferred in the form of a digital nominal value on a line 75 to a digital-/analog converter 59. A motor current proportional to an analog nominal value 76 appearing at the output of the D/A converter 59, is produced by a motor current regulator 60 and fed to the motor 32. The motor current is held constant by means of a schematically represented negative feedback, as shown both in FIG. 4, as well as in FIG. 9, the latter figure being derived from a publication of the German firm AEG-TELEFUNKEN established "Design of Control Circuits of Drive Technology". The analog value proportional to the distance or spacing 30 (FIG. 2) and yielded by the potentiometer 20 via line 21 connected with the non-illustrated wiper or slider thereof is initially fed to an analog/digital converter 54 having an output signal which is fed to the microcomputer 51 via a line 72. The distance or spacing 30 is set by the motor 22 which receives the required current via a driver stage 56. The driver stage 56 can be actuated both manually via a push button or keys 57 as well as automatically by an output signal of the microcomputer 51 delivered via a line 73. FIG. 8 is a schematic circuit diagram of the driver stage 56 showing its connection to the push button 57 and the microcomputer 51.

Figure 7:
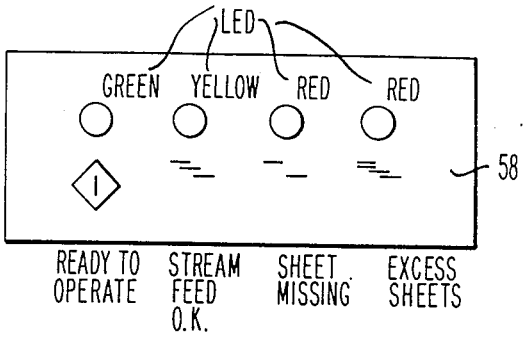
FIG. 7 is a front elevational view of a display for use with the invention.

A display 58 of any suitable construction which operates with LEDs and which is controlled by the microcomputer 51 indicates to the user the correct sheet overlap or imbrication as well as the possible occurrence of missing sheets or multiple sheets. An example of such a display is shown in FIG. 7.

The operating mode of the monitoring device can be set with a symbolically illustrated, manually operated switch 53. The occurrence of several signals of the monitoring device is explained with regard to FIG. 5. The diagrammatically illustrated overlap of individual sheets of paper B is shown at 80, the leading end region of a succeeding sheet in the direction of movement from the right-hand toward the left-hand side being disposed underneath the trailing end region of a preceding sheet. The overlap representation 80 simply shows single overlaps. A curve 81 shows between broken lines the total thickness of the sheets B as it occurs during the course of time or timed sequence at the scanning roller 13. The total thickness fluctuates between the thickness d of a single sheet and double the thickness of a single sheet, i.e. *2d*, where two sheets B overlap. To suppress any faults or disruptions, for example, due to slight deviations in the thickness of the sheets, the height of the scanning roller 13 above the transport roller 9 (FIG. 2) is greater than the thickness d of a single sheet by a given percentage Td (less than 100%) yet less than double the sheet thickness *2d*. This fact is illustrated by the scanning roller 13 shown above the curve 81.

At the times when overlaps between two sheets B occur at the scanning roller 13, the scanning roller 13 turns and the sensor 14 delivers a signal having a duration which is determined by the angle of rotation of the scanning roller 14 and represented by the curve progression 82. The value S1 representing the duration of this signal, corresponds to the length of an overlap of two sheets B as appears in the illustrated example. During a subsequent length of travel S3 of the sheets B, the sensor 14 delivers no signals because the scanning roller 13 makes no contact with any sheet and is therefore stationary. The length of travel S2 is constant due to the construction of the sheet feeder. This length of travel S2 corresponds to the mutual spacing between the leading edges of two sheets directly following one another and is the sum of the values S1 and S3. This relationship applies only when, as in the example, a maximum of two sheets overlap. The values S1, S2 and S3 are not determined by counting the pulses of the signal supplied by the sensor 14, but rather by counting the pulses of the signal which is provided by the clock generator 6 and which is constantly applied during operation of the printing machine. The sheet length b, which can be used for setting or adjusting format-dependent equipment of the printing machine 1, is determined by the microcomputer 51 from the values S1, S2 and S3 and from the maximum number of mutually overlapping sheets. In the example where only two sheets can overlap in a correct overlapping or imbricated structure, the sheet length b is the sum of the lengths S1 and S2.

Length determination of the aforementioned values based upon the number of pulses of the signal produced by the clock generator 6 is independent of speed. The machine control 50 receives length data via the bus system 70 for setting or adjusting format-dependent equipment on the printing machine 1.

The scanning roller 13 should preferably not be mounted free of friction, but rather with some friction to ensure that it will quickly come to a standstill at the end of its contact with the sheets. To ensure that the acceleration of the scanning roller 13 from the stationary condition thereof does not cause damage to the surface of the sheets of paper, the scanning roller 13 is constructed with a very light weight and moment of inertia and is basically formed of a lightweight wheel of plastic material.

With the aid of FIG. 6, there is hereinafter described how the monitoring device (with the scanning device shown in FIG. 2) performs the setting or adjustment operation. At start-up of the printing machine, a check is initially performed, which is based on the data stored in the memory of the machine control 50, as to whether resetting of the scanning roller 13 is necessary. For example, this is the case when, after a failure or defect, the overlapping sheets delivered by the sheet feeder were removed, rendering it necessary once again to monitor the structure of an overlapped stream or imbricated sheet feed. If resetting is not necessary, sheet monitoring is resumed at the point where it was interrupted.

Figure 5:
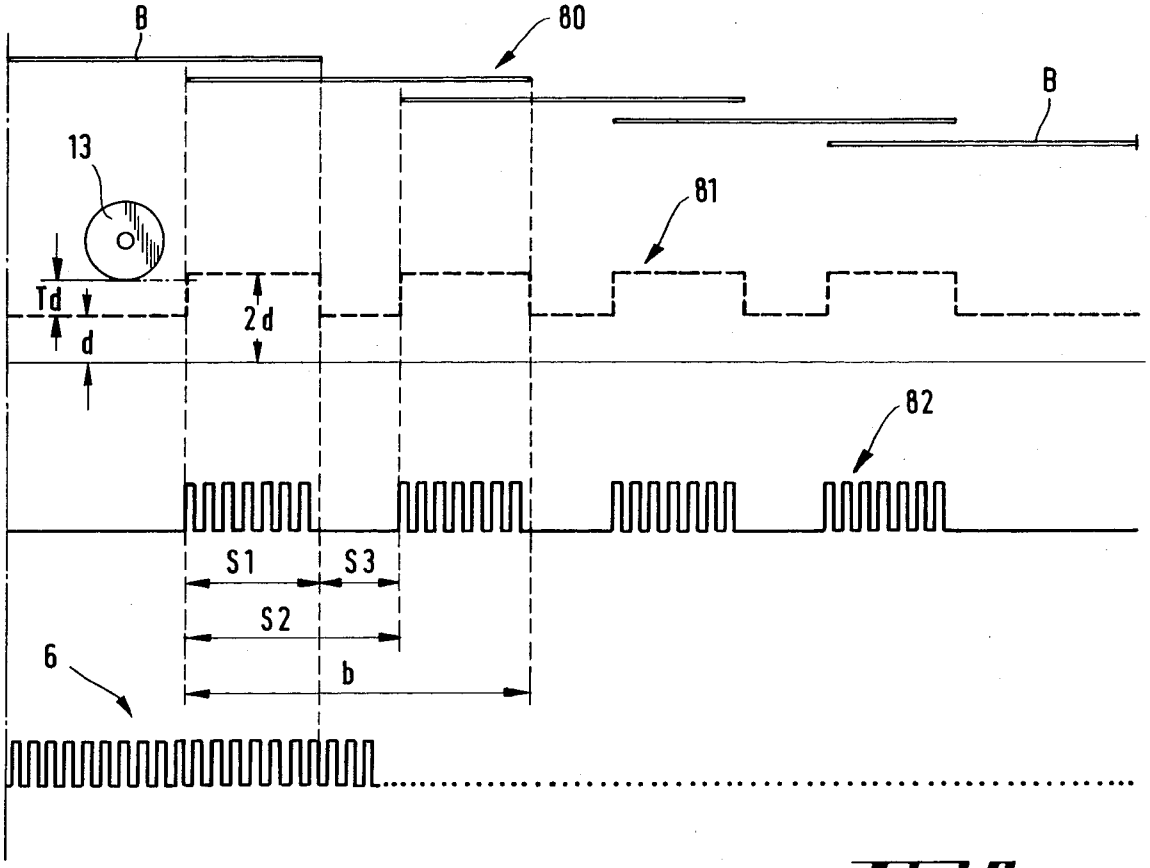
FIG. 5 is a plot diagram of different signal spectra or patterns.
Figure 6:
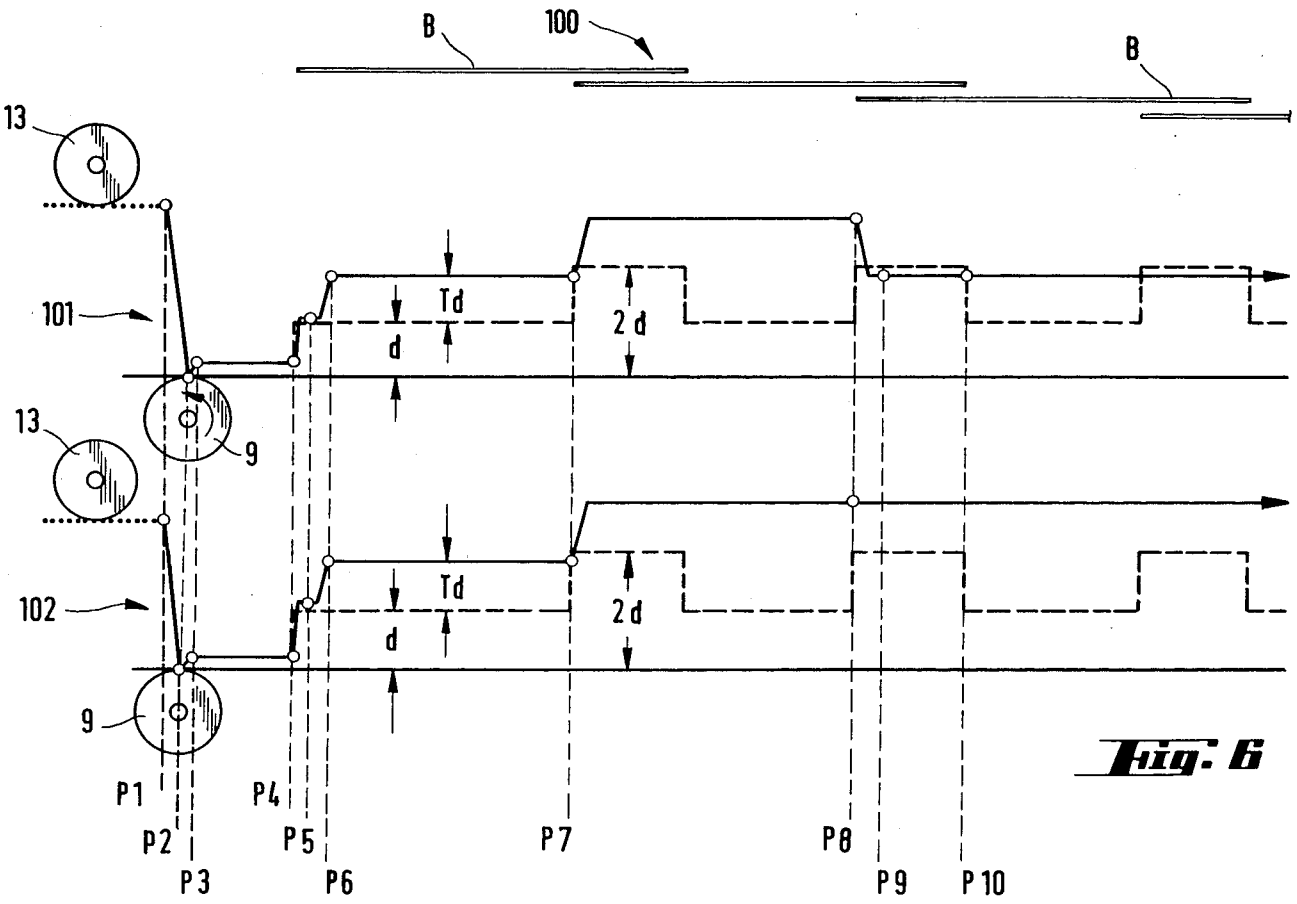
FIG. 6 is a plot diagram in which two different modes of operation of the device are shown.

The subdiagram 100 in FIG. 6 shows the arrangement of the overlapping sheets B, which travel from the right-hand to the left-hand side of the figure. In a subdiagram 101, a progression of the total thickness of the sheets is represented by a broken line, which is similar to the curve 81 in FIG. 5. A solid line shows the height setting of the scanning roller 13 for the sheet feed monitoring with length determination and, in a subdiagram 102, for a pure multiple sheet monitoring. In the subdiagram 102, once again, a broken line shows the progression of the thickness of the sheets in the same way as in the subdiagram 101.

The time axis in FIG. 6 runs from left-hand to the right-hand side of the figure. After a start, the scanning roller 13 is moved at the time P1, in conjunction with the lever 11 and the motor 22, out of its original or base position, in which it is located above the rotating transport roller 9, towards the transport roller. The instant the sensor 14 emits signals which indicate the rotation of the scanning roller 13, the latter has made contact with the transport roller 9. This occurs at the instant of time P2. The voltage delivered by the potentiometer 20 on the line 2 is now fed to the microcomputer 51 where its value is assigned to the value 0 for the distance or spacing 30. By switching on the motor 22, the scanning roller 13 is then lifted from the transport roller 9 so that it stops rotating, and the sensor 14 therefore no longer emits any signals; this is the case at the instant of time P3. The hereinafore described operations are completed before the first sheet reaches the scanning roller 13.

At the instant of time P4, the scanning roller 13 is turned by the arrival of the leading edge of the first sheet, and the sensor 14 emits signals. The leading edge of the first sheet (or the instant of time P4) must appear within a predetermined machine angle (rotary position of the part of the machine driving the clock generator 6); if this is not the case, the monitoring device signals that a sheet is missing. After detecting the first sheet at the instant P4, the scanning roller 13 is again raised until the sensor 14 no longer emits signals; this is the case at the instant of time P5. The signal delivered by the potentiometer 20 at this instant of time is then read and stored by the microcomputer 51. Taking into consideration the characteristic curve of the potentiometer 20 and the pitch of the thread of the rod 18, the microcomputer 51 determines the sheet thickness d and then, in accordance with a stored table, determines the contact force with which the motor 32 is to press the lever 11 in counterclockwise direction, as viewed in FIG. 2 i.e. against the sheets and against the limit stop 27, respectively, as well as the motor current corresponding to the contact force. In addition, a new distance or spacing 30 is calculated which is slightly smaller than double the sheet thickness 2d, and this new distance is set. This procedure is completed at the instant of time P6.

The aforementioned distance or spacing which corresponds to the single sheet thickness d plus a tolerance Td (smaller than d) is selected so that, on the one hand, irregularities in the printing material (paper sheets) do not cause the scanning roller 13 to turn but, on the other hand, however, the leading edge of the next sheet is clearly detected at the instant of time P7. The microcomputer 51 checks once again whether the leading edge of the next sheet occurs within a permissible machine angle range at the instant of time P7; the control of the microcomputer 51 then lifts the scanning roller 13 a distance corresponding to a sheet thickness d. This procedure is completed shortly after the instant of time P7. When the scanning roller 13 is raised at instants of time P4 and P7, a memory location in the microcomputer 51 is incremented by an amount 1 so that the number n of overlapping sheets is also known at a predetermined instant of time.

At the instant of time P8 which corresponds to the expected leading edge of the third sheet in FIG. 6, the operating mode selected by the operator i.e. either multiple sheet monitoring (curve 102) or sheet feed monitoring with sheet length measurement (curve 101), is initially determined by the microcomputer 51, and the distance or spacing 30 is then adjusted as shown in the curve 101 to a value $(n-1)xd+Td$ at the instant of time P9 or as shown in the curve 102 to a value $nxd+Td$.

The transport path of the sheets between the instants of time P7 and P8 correspond to the constant length S2 in FIG. 5 which is presupposed by the type of sheet feeder 2 used.

From the fact that, at the instant of time P8, the scanning roller 13 is not rotated, the device detects that a double overlap exists in the sheet stream feed.

The instant of time P9 occurs shortly after the instant of time P8. In the case of sheet feed monitoring with sheet length measurement (curve 101), the contact roller 13 makes contact with the surface of the overlapped or imbricated sheets and is turned following an extremely brief period of time after the leading edge of the third sheet B in FIG. 6 has reached the contact roller 13. The rotation stops at the instant of time P10 because the overlap of two sheets ends thereat. The control unit can then calculate the sheer length from the feed of the sheets between the instants of time P4 and P7 as well as the overlap length measured between the instants of time P8 and P10. If the scanning roller 13 cannot be lowered fast enough after the instant of time P8, then the overlap following the instant of time P10 should be used for measuring the length of the overlap. The device can continuously determine the sheet length.

FIG. 6 shows only double overlapping. If more than two sheets overlap simultaneously, then, in the case of sheet feed monitoring (curve 101) the sheet length cannot be calculated yet at the instant of time P10, but rather only at a suitable later instant of time. In this way, the sheet length can be determined only after an instant of time, at which a maximum number of overlaps occurs.

In the case of the sheet feed monitoring (curve 101), the described values S1, S2, S3, n shown in FIG. 5 are continuously measured and calculated, respectively. Because, both in the case of missing sheets, as well as of multiple sheets and extreme sheet displacements which impair the function of the printing machine, signal transmission by the sensor 14 on the scanning roller 13 occurs, these faults are reliably detected and signaled. In this mode of operation, the scanning roller 13 is rotated for each overlap of two sheets.

If a sheet is missing, this fact is signaled to the operator by means of the LED indicator 58 and, if necessary, the sheet feed is interrupted by the transmission of this signal to the machine control 50. The sheets already on the feed table 5 are still printed thereafter, followed by interruption of the printing operation. The fault signal is cancelled by a start command given by the operator and the structure of the overlapped sheet stream or imbricated sheer feed is monitored once again as described hereinabove.

Too many conveyed sheets (multiple sheets) are also optically displayed and signaled to the machine control 50. The faulty location in the flow of sheets i.e. in the succession of sheets, is then conveyed farther after the sheet feeder has been deactivated until the multiple sheets have reached a position easily accessible by the operator and the machine has actually completed a printing operation. Printing is then stopped by the machine and the sheet which has been conveyed too far can be removed effortlessly by the operator. After the printing machine has been started, the structure of the overlapped or imbricated sheet stream feed is controlled or monitored once again.

In the case of the pure multiple sheet monitoring or control as represented by the curve 102, the sensor 14 normally transmits no signal because the scanning roller 13 does not come into contact with the sheets even in the vicinity of the overlaps. By monitoring rotation of the scanning roller 13 in light of the output signal of the sensor 14, exclusively, sheets which have been conveyed too far are detected as well as long folds in the printing material which impair the function of the printing machine if these folds cause the scanning roller 13 to corotate.

Shortly after the instant of time P10 i.e. the detection of the trailing edge of the second sheet in FIG. 6, the device has determined for the first time all data necessary for the described sequences of function of the device for the sheet feed monitoring with sheet length measurement (diagram 101).

Shortly before the instant of time P8, where the absence of an increase in thickness indicates that only double overlaps occur, the device, in the case of multiple sheet monitoring (diagram 102), has determined all data which are necessary for the function sequences.

The microcomputer 51 is informed of how many pulses of the signal provided by the clock generator 6 occur until a sheet delivered by the sheet feeder arrives at the scanning roller 13. If the sheet feeder is switched off during operation of the printing machine 1 while the sheets on the feed table 5 are still to be printed, then the total thickness of the sheets moving past the scanning roller 13 gradually decreases. To ensure that this reduction of the overlapped sheet feed can also be reliably monitored, the scanning roller 13 is lowered by means of the microcomputer 51 by the thickness of one sheet shortly after the trailing edge of the sheet has passed by, when an off signal of the sheet feeder informs the microcomputer 51 that the sheet feeder has been switched off. As long as the sheets are arranged and fed correctly, the scanning roller 13 is not rotated. However, if one of the sheets has folds, or a multiple sheet occurs, this is detected by the scanning roller 13 which, in such a case, then rotates. At this stage of scanning, a missing sheet cannot be detected; however, the missing sheet must have been detected beforehand as the scanning roller scanned the leading edges of the sheets.

We claim:

1. Device for monitoring imbricated sheets stream fed to a printing machine, including a scanning roller rotatably mounted on a carrier above a base of imbricatedly arranged sheets, the carrier being adjustable by a servomotor so that the scanning roller rotates only when a given number of sheets are arranged on top of one another, a sensor cooperatively associated with the scanning roller, and an intermediate roller movable transversely with respect to its axis and substantially perpendicularly to the plane of the sheets, the intermediate roller being disposed between the scanning roller and the base, comprising a device for measuring the distance of at least one of the scanning roller and the intermediate roller to the base of the overlapped sheets, a control unit coupled with the sensor, the servomotor and said measuring device and a device for producing a signal characteristic of an angle of rotation of the printing machine, said signal being fed to said control unit, said control unit having means for monitoring the imbricated sheet structure, the scanning roller being mounted so that its rotation is unlimited, and the sensor having means for detecting all rotational movements of the scanning roller.

2. Device according to claim 1, wherein said control unit has means for determining the sheet length automatically.

3. Device according to claim 1, wherein said control unit has means for determining the thickness of the sheet by vertical adjustment of the carrier and for setting said one of said scanning roller and said intermediate roller to a height which is greater than the thickness of a single sheet yet smaller than double the sheet thickness, as a first sheet passes under said one of said scanning roller and said intermediate roller.

4. Device according to claim 1, wherein said control unit has means for evaluating a signal characteristic of the angle of rotation of the printing machine in order to determine thereby the length of the overlap region, when the signal of the sensor indicating the rotation of the scanning roller is present.

5. Device according to claim 1, including a force-producing device for exerting a force adjustable by said control unit on said one of said scanning roller and said intermediate roller.

6. Device according to claim 5, wherein said force-producing unit is an electric motor.

7. Device according to claim 5, including a memory for storing a value of the force to be exerted by said force-producing unit, at least in dependance upon the paper thickness.

8. Device according to claim 7, wherein said control unit has means for automatically setting the force to a value stored in the memory.

9. Device according to claim 4, wherein said control unit has means for comparing the signal provided by the sensor and the signal characteristic of the rotary speed of the printing machine and transmitting a fault signal in the case of deviations therebetween which exceed a predetermined value.

10. Device according to claim 4, wherein said signal characteristic of the rotary speed of the printing machine is a clock signal, and said control unit has means for comparing the appearance of the leading edge of a sheet at the scanning roller with the phase of the clock signal and transmitting a fault signal in the case of a given impermissible deviation.

11. Device according to claim 1, wherein said control unit has means for monitoring a reduction of the imbricated sheet feed when a signal indicating switch-off of the sheet feeder is present.

* * * * *